US011588278B2

(12) United States Patent
Pritz et al.

(10) Patent No.: US 11,588,278 B2
(45) Date of Patent: Feb. 21, 2023

(54) CONNECTOR ASSEMBLY

(71) Applicant: MD ELEKTRONIK GmbH, Waldkraiburg (DE)

(72) Inventors: Helmut Pritz, Ampfing (DE); Sabrina Schnobrich, Waldkraiburg (DE); Christian Neulinger, Polling (DE); Dominik Schroll, Ampfing (DE); Marijela Bajic, Waldkraiburg (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 0 days.

(21) Appl. No.: 17/533,150

(22) Filed: Nov. 23, 2021

(65) Prior Publication Data

US 2022/0173551 A1 Jun. 2, 2022

(30) Foreign Application Priority Data

Dec. 2, 2020 (DE) ..... 10 2020 132 011.6

(51) Int. Cl.
*H01R 13/6591* (2011.01)
*H01R 13/506* (2006.01)

(52) U.S. Cl.
CPC . *H01R 13/65912* (2020.08); *H01R 13/65915* (2020.08); *H01R 13/506* (2013.01)

(58) Field of Classification Search
CPC ..... H01R 13/65912; H01R 13/65915; H01R 13/506; H01R 13/6593; H01R 2103/00
See application file for complete search history.

(56) References Cited

U.S. PATENT DOCUMENTS 10,978,832 B1 * 4/2021 Schroll ..... H01R 13/506
2019/0173243 A1 6/2019 Annequin

FOREIGN PATENT DOCUMENTS

| | | | |
|---|---|---|---|
| DE | 102018104253 | A1 | 8/2019 |
| DE | 102018132823 | A1 | 6/2020 |
| EP | 3273542 | A1 | 1/2018 |
| EP | 3584891 | A1 | 12/2019 |
| EP | 3723212 | A1 | 10/2020 |
| EP | 3783751 | A1 | 2/2021 |
| WO | WO 2018037603 | A1 | 3/2018 |

* cited by examiner

*Primary Examiner* — Oscar C Jimenez
*Assistant Examiner* — Paul D Baillargeon
(74) *Attorney, Agent, or Firm* — Leydig, Voit & Mayer, Ltd.

(57) ABSTRACT

A connector assembly includes a connector and a cable connected thereto. First and second inner conductor contacts are disposed within an outer conductor sleeve of the connector. The cable has first and second insulated inner conductors. The inner conductor contacts each have a mating portion, for mating with a mating connector, and a connecting portion, in which the inner conductors are connected, with a transition portion extending therebetween. The inner conductor contacts have a first contact spacing in the mating portion and a smaller second contact spacing in the connecting portion. In the transition portion, a transition from the first to the second contact spacing occurs continuously. In an end portion of the cable, the inner conductors are disposed parallel to each other within the outer conductor sleeve and are spaced apart from each other by a conductor spacing equal to the second contact spacing.

15 Claims, 2 Drawing Sheets

CONNECTOR ASSEMBLY

CROSS REFERENCE TO RELATED APPLICATION

This application claims benefit to German Patent Application No. DE 10 2020 132 011.6, filed on Dec. 2, 2020, which is hereby incorporated by reference herein.

FIELD

The invention relates to a connector assembly including a connector and a cable connected to the connector. The connector assembly is especially suited for cables having at least one twisted pair of inner conductors.

BACKGROUND

In order to releasably connect cables to electrical components or to another cable, connector systems are used in practice. Connector systems provide an electrically conductive and mechanically stable connection between the cable and the desired connection partner. To this end, typically contact elements are mounted to the cable, the contact elements being capable of being coupled to complementary contact elements on the connection partner. Due to the increasing digitalization and automation, increasingly higher demands are being placed on the data transfer rates of, in particular, high-frequency data cables. However, the desire for releasable connections poses a particular problem in this context. This problem resides particularly in that the connector systems required for this purpose represent discontinuities with respect to the electrical characteristics. For example, a pluggable connection generally has a negative effect on the attenuation of a high-frequency signal to be transmitted.

This problem is particularly pronounced in cables having twisted pairs of inner conductors, which are commonly known as twisted pair cables. In order for contact elements that enable connection to a connection partner to be attached to the inner conductors of the cable, it is usually unavoidable to dissolve the twisted arrangement of the inner conductors along a portion thereof. Moreover, to improve signal transmission, such cables may have additional shields surrounding the twisted inner conductors. Generally, this shielding must also be removed in a certain portion to enable the connecting elements to be attached to the inner conductors.

However, such measures have a particularly negative effect on the signal transmission characteristics of the cable or of the connection. In order to ensure compatibility between different connector systems, there is also a requirement for standardized connector systems, for example through a defined connector geometry, especially in the automotive field. However, since this limits the design freedom of the respective connection system, this requirement makes it more difficult to provide connection systems that affect the electrical characteristics of the cable as little as possible.

DE 10 2018 104 253 A1 discloses a connector arrangement having a connector and a cable that has a first and second conductor for transmitting a differential signal. The cable has a first portion and the connector has a second portion in which the conductor pair has electric contacts. The cable is fastened to the connector at a connector-side end of the first portion. The conductors of the conductor pair are fastened to the conductors of the connector at a cable-side end of the second portion. An intermediate portion is formed between the first portion and the second portion, the conductor pair being surrounded by an outer conductor in the intermediate portion. The outer conductor has a deformation in at least one part of the intermediate portion, the deformation reducing a distance between the outer conductor and the conductors or a distance between the conductors in a region of the deformation.

DE 10 2018 132 823 A1 discloses a cable connector arrangement having a cable connector and an electrical cable having a plurality of individual lines each having an insulation and an electrical conductor. The cable connector arrangement has a front section, which is configured for connection to a corresponding mating connector, a rear section, in which the individual lines are surrounded by a cable sheath, and an interposed central section. The electrical conductors of two of the individual lines have a first mutual nominal distance in the rear section and have a second mutual distance in the front section, which second distance is greater than the first distance. The distance between the electrical conductors of the two individual lines increases in the central section in the direction of the front section. In the central section, at least one pressing means is provided and configured to press the two individual lines together such that the insulations thereof undergo a mechanical deformation.

SUMMARY

In an embodiment, the present disclosure provides a connector assembly. The connector assembly includes a connector and a cable connected to the connector. The connector has an outer conductor sleeve, a first and a second inner conductor contact being disposed within the outer conductor sleeve. The cable has a first and a second insulated inner conductor, a shield surrounding the first and second inner conductors, and a jacket surrounding the shield, the first and second inner conductors being stripped of the shield and the jacket in an end portion of the cable. The first and second inner conductor contacts each have a mating portion by which the first and the second inner conductor contacts are connectable to complementary inner conductor contacts of a mating connector, a connecting portion in which the first inner conductor contact is electrically conductively connected to the first inner conductor and the second inner conductor contact is electrically conductively connected to the second inner conductor, and a transition portion that connects the mating portion to the connecting portion. The first and second inner conductor contacts are disposed parallel to each other in the mating portion and in the connecting portion. The first and second inner conductor contacts have a first contact spacing in the mating portion and a second contact spacing in the connecting portion, the first contact spacing being greater than the second contact spacing. In the transition portion, a transition from the first contact spacing to the second contact spacing occurs continuously over a length of the transition portion. In the end portion, the first and second inner conductors are disposed parallel to each other within the outer conductor sleeve and in spaced-apart relation to the outer conductor sleeve, and are spaced apart by a conductor spacing equal to the second contact spacing

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
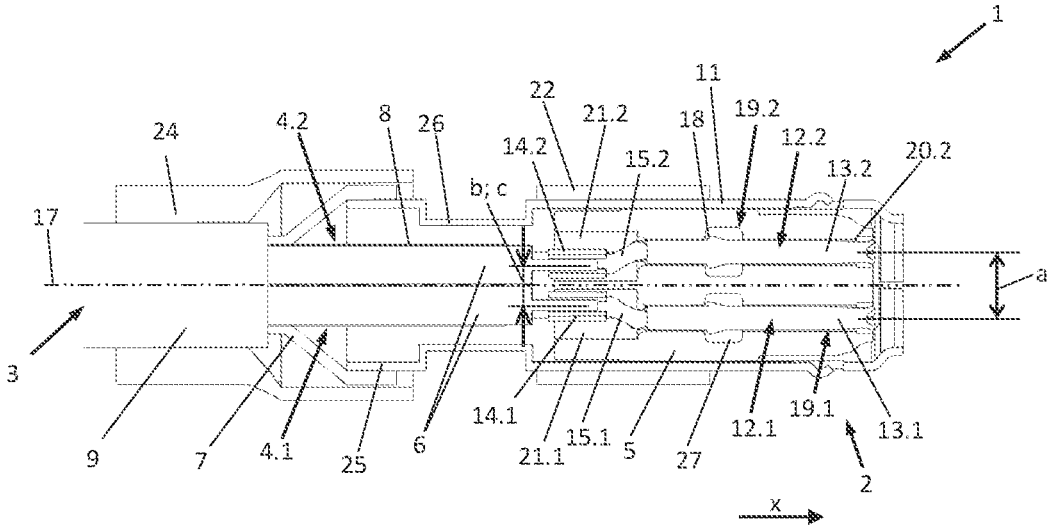
FIG. 1 is a sectional view of an embodiment of a connector assembly according to the invention.

The approaches disclosed in the prior art for solving the problem described above have in common that the electrical characteristics are only slightly improved by the respective connectors and/or that the attachment of the connectors to the respective cables is associated with considerable assembly effort. In an embodiment, the present invention overcomes at least one of the disadvantages of the above-mentioned prior art and provides a connector assembly that affects the electrical characteristics of a cable connected to the connector assembly as little as possible and, in addition, is easy to manufacture and to mount on the cable.

A connector assembly according to an embodiment of the invention includes a connector and a cable connected to the connector. The cable has a first and a second insulated inner conductor. Both the first and second inner conductors may include one or more electrically conductive wires surrounded by an insulation. The inner conductors are preferably twisted together and preferably form a pair of inner conductors for transmission of a differential signal. The first and second inner conductors are surrounded by a shield. The shield surrounds both inner conductors together. The shield may be, for example, a wire mesh. In addition, a shielding film may be disposed between the shield and the first and second inner conductors or between the shield and the jacket, the shielding film also surrounding both inner conductors together. The shield is in turn surrounded by a jacket. The first and second inner conductors are stripped of the shield and the jacket in an end portion of the cable. To this end, the shield may, for example, be partially removed, partially expanded and/or folded back. Preferably, the jacket is removed in the entire end portion. The connector has an outer conductor sleeve, a first inner conductor contact and a second inner conductor contact. The first and second inner conductor contacts are disposed within the outer conductor sleeve. The first and second inner conductor contacts each have a mating portion in which the first and the second inner conductor contacts are connectable to a complementary inner conductor contact of a mating connector. Furthermore, the first and second inner conductor contacts have a connecting portion in which the first inner conductor contact is electrically conductively connected to the first inner conductor and the second inner conductor contact is electrically conductively connected to the second inner conductor. To be able to create an electrically conductive connection between the inner conductors and the respective inner conductor contacts, an insulation of the inner conductors may be removed in the region of the connecting portions of the inner conductor contacts. The inner conductors may for example be connected to the inner conductor contacts by crimping. The mating portion and the connecting portion of the first and second inner conductor contacts are respectively interconnected by a transition portion.

Furthermore, the first and second inner conductor contacts are disposed parallel to each other both in the mating portion and in the connecting portion. In addition, at least the mating portions are disposed parallel to a mating direction of the connector. It is preferred here that the respective connecting portion be disposed parallel to the respective mating portion. The first and second inner conductor contacts have a first contact spacing in the mating portion and a second contact spacing in the connecting portion. The first contact spacing is greater than the second contact spacing. A transition from the first contact spacing to the second contact spacing occurs in the transition portion. The transition occurs continuously over a length of the transition portion. "Continuously" may be understood to mean that a smooth, especially linear transition without jumps and/or steps is provided. The continuous transition between the first and second contact spacing makes it possible to ensure that as few structural disturbances as possible are produced which negatively affect the electrical characteristics. The first and second inner conductors are disposed parallel to each other in the end portion and within the outer conductor sleeve. In the case of a cable having twisted inner conductors, it is preferred that this twisted arrangement of the inner conductors be dissolved, at least in the end portion. Preferably, a section of the end portion in which the first and second inner conductors are disposed parallel to each other is longer than a section of the end portion in which the first and second inner conductors are not disposed parallel to each other. Even more preferably, the section of the end portion in which the first and second inner conductors are disposed parallel to each other is longer than any other section of the end portion in which the first and second inner conductors are not disposed parallel to each other. Moreover, the first and second inner conductors may be disposed parallel to each other in the entire end portion. Furthermore, the first and second inner conductors are spaced apart from the outer conductor sleeve in the end portion so that the first and second inner conductor contacts are disposed within the outer conductor sleeve without contact with the outer conductor sleeve. In the end portion, the first and second inner conductors are spaced apart by a conductor spacing equal to the second contact spacing. Preferably, the conductor spacing in the end portion is constant, the conductor spacing preferably being equal to the sum of the thickness of the insulation of the first inner conductor and the thickness of the insulation of the second inner conductor.

The "contact spacing" may be understood to be the shortest distance between an imaginary center of a cross-sectional area of the first inner conductor contact in a plane perpendicular to a main direction of extent and an imaginary center of a cross-sectional area of the second inner conductor contact in a plane perpendicular to a main direction of extent.

The "conductor spacing" may be understood to be the shortest distance between an imaginary center of a cross-sectional area of the first inner conductor in a plane perpendicular to a main direction of extent and an imaginary center of a cross-sectional area of the second inner conductor in a plane perpendicular to a main direction of extent.

The connector assembly according to embodiments of the invention makes it possible to provide a connection means that has a much smaller effect on the electrical characteristics of the cable. In addition, the construction of the connector assembly has a low degree of complexity, so that the connector assembly and the connection to a cable are much easier and less costly to make than with prior art approaches.

The mating portions of the first and second inner conductor contacts may be disposed in a main plane. Furthermore, the connecting portions and/or the transition portions may also be disposed in the main plane. It is also particularly advantageous if the first and second inner conductors are disposed in the main plane. Furthermore, the mating portions, the transition portions, the connecting portions and/or the first and second inner conductors are preferably disposed in the main plane if and only if their imaginary centers of the cross-sectional areas in planes perpendicular to the main direction of extent are located in the main plane.

The first and second inner conductor contacts may be disposed symmetrically, in particular mirror-symmetrically, with respect to each other, and the plane of symmetry may be perpendicular to the main plane and parallel to the mating direction. In addition, it is preferred that the first and second inner conductors also be disposed symmetrically with respect to the plane of symmetry. The plane of symmetry preferably extends between the first and second inner conductor contacts or inner conductors.

In the transition portion, the first and/or the second inner conductor contact(s) may form an angle with the plane of symmetry, the tangent function of which angle is equal to the result of a quotient whose dividend is given by the difference between the first contact spacing and the second contact spacing and whose divisor is given by twice the length of the transition portion. As for the difference, the first contact spacing is the minuend and the second contact spacing is the subtrahend. The length of the transition portion preferably refers to the extent of the transition portion in a dimension parallel to the mating direction. One arm of the angle is preferably formed by the plane of symmetry itself, and one arm is formed by the inner conductor contact in the transition portion. If the transition portion does not have a linear shape, the arm is preferably formed by the main direction of extent of the transition portion.

In the end portion, the first and second inner conductors may be disposed within a shielding film. In this connection, it is preferred that the first and second inner conductors be disposed together in a shielding film. Furthermore, it is preferred that the shielding film be removed in the end portion only in a region where the insulation of the inner conductors is removed.

The connector may have an insulator having a first and a second socket chamber. The insulator may be disposed within the outer conductor sleeve. The first inner conductor contact may be disposed in the first socket chamber, and the second inner conductor contact may be disposed in the second socket chamber. The inner conductor contacts are preferably interlockingly connected to the insulator. The socket chambers are preferably disposed parallel to each other and parallel to the mating direction. Preferably, the first and second inner conductor contacts are spaced by a constant distance from the outer conductor sleeve along the mating direction within the insulator.

The first and second socket chambers may each have a first socket chamber portion in which the mating portion of the respective inner conductor contact is disposed and a second socket chamber portion in which the connecting portion and the transition portion of the respective inner conductor contact are disposed. In this connection, the first socket chamber portion may have a smaller diameter than the second socket chamber portion. In addition, the first and/or second socket chamber(s) may have recesses for interlocking connection with the respective inner conductor contact disposed in the socket chamber. The inner conductor contact may, for example, have latching noses which engage in the recesses. The recesses are preferably disposed in the first socket chamber portion.

In the region of the insulator, the outer conductor sleeve may have a collar member on the side facing away from the insulator, the collar member having at least one fastening element. The collar member may be disposed on the outer conductor sleeve, for example as an overmold of the outer conductor sleeve. Preferably, the fastening elements is formed integrally with and of the same material as the collar member. The fastening element is preferably used to connect the connector to a connector housing. The fastening element may, for example, take the form of as a snap-type fastener that is releasably connectable to the connector housing.

The connector may be connected to the cable via a compression sleeve. The cable and the connector are preferably disposed within the compression sleeve and are preferably connected to the compression sleeve by the compression sleeve being frictionally connected to the cable and the connector by a reduction in diameter. The compression sleeve may have regions of different diameter. In this connection, it is preferred that the compression sleeve have a larger diameter in a region where the connector is disposed within the compression sleeve than in a region where the cable is disposed. Furthermore, it is preferred that the compression sleeve be permanently connected to the outer conductor sleeve and to the jacket.

The shield may be disposed between the compression sleeve and the outer conductor sleeve. On a side facing the compression sleeve, the outer conductor sleeve may have a profiled surface into which the shield is at least partially pressed. It is also preferred that the shield be expanded in the end portion so that the shield can be very readily positioned between the compression sleeve and the outer conductor sleeve. Furthermore, it is preferred that the outer conductor sleeve be electrically conductively connected to the shield.

The outer conductor sleeve may have a pressing region in which the outer conductor sleeve is connected to the compression sleeve and the shield. The outer conductor sleeve may have an intermediate region adjoining the pressing region. In the pressing region, the first and second inner conductors may be spaced from the outer conductor sleeve by a greater distance than in the intermediate region. In this connection, it is particularly preferred that the distance of the inner conductors from the outer conductor sleeve remain constant in the intermediate region and/or in the pressing region. It is further preferred that the outer conductor sleeve have a constant inner diameter in the pressing region and/or in the intermediate region, but that it have a larger inner diameter in the pressing region than in the intermediate region. In this context, the distance of the inner conductors from the outer conductor sleeve may be understood to be the shortest distance between the inner conductor and the outer conductor sleeve.

In the connecting portion, the inner conductor contacts may be spaced from the outer conductor sleeve by a distance greater than the distance between the inner conductors and the outer conductor sleeve in the intermediate region. This is preferably ensured by the outer conductor sleeve having a larger inner diameter in the region of the exposed inner conductors than in the intermediate region. The intermediate region preferably adjoins the pressing region in the mating direction. The distance between the inner conductor contacts and the outer conductor sleeve in the connecting portion is preferably constant along the main direction of extent of the connecting portion.

In the connecting portion, the inner conductor contacts may be spaced from the outer conductor sleeve by a distance equal to the distance between the inner conductors and the outer conductor sleeve in the pressing region. Furthermore, it is preferred that the inner diameter of the outer conductor sleeve in the pressing region be equal to the inner diameter of the outer conductor sleeve in the region where the inner conductor contacts are disposed.

FIG. 1 shows, in sectional view, an embodiment of a connector assembly 1 according to the invention. The sectional plane is parallel to a mating direction x and lies in a main plane. Connector assembly 1 is composed of a connector 2 and a cable 3. Cable 3 is composed of a first and a second insulated inner conductor 4.1; 4.2, each surrounded by an insulation 6. The two inner conductors 4.1; 4.2 are surrounded by a common shield 7. In the present exemplary embodiment, shield 7 is formed by a tubular wire mesh surrounding the two inner conductors 4.1; 4.2. In addition, a shielding film 8 is disposed between shield 7 and inner conductors 4.1; 4.2. Shield 7 is surrounded by a jacket 9, which protects inner conductors 4.1; 4.2 from external influences.

Connector 2 is composed of an outer conductor sleeve 11 in which an insulator 5 is disposed. Insulator 5 has a first and a second socket chamber 19.1; 19.2. Each of the two socket chambers 19.1; 19.2 is divided into a first socket chamber portion 20.1; 20.2 and a second socket chamber portion 21.1; 21.2. Second socket chamber portion 21.1; 21.2 has a larger diameter than the respective first socket chamber portion 20.1; 20.2. The two socket chambers 19.1; 19.2 extend with their central axes parallel to mating direction x and in the main plane. Moreover, the two socket chambers 19.1 and 19.2 extend parallel to each other.

A first inner conductor contact 12.1 is disposed within first socket chamber 19.1. A second inner conductor contact 12.2 is disposed within second socket chamber 19.2. First and second inner conductor contacts 12.1; 12.2 each have a mating portion 13.1; 13.2, a connecting portion 14.1; 14.2, and a transition portion 15.1; 15.2. Mating portions 13.1; 13.2 are disposed in first socket chamber portions 20.1; 20.2. Inner conductor contacts 12.1; 12.2 each have latching noses 18 in mating portion 13.1; 13.2. Latching noses 18 are disposed in recesses 27 of insulator 5 to interlockingly but releasably secure inner conductor contacts 12.1; 12.2 in insulator 5. Connecting portions 14.1; 14.2 and transition portions 15.1; 15.2 are disposed in second socket chamber portions 21.1; 21.2. First inner conductor contact 12.1 and second inner conductor contact 12.2 have a first contact spacing a in mating portion 13.1; 13.2 and a second contact spacing b in the connecting portion, the first contact spacing a being greater than the second contact spacing b. The transition between the first and second contact spacings a and b occurs in transition portions 15.1; 15.2.

In an end portion, the two inner conductors 4.1; 4.2 are stripped of shield 7 and jacket 9 and extend parallel to each other. The exposed inner conductors 4.1; 4.2 are disposed within outer conductor sleeve 11. In connecting portion 14.1, first inner conductor 4.1 is electrically conductively connected to first inner conductor contact 12.1. In connecting portion 14.2, the second inner conductor 4.2 is electrically conductively connected to the second inner conductor contact 12.2. To enable an electrically conductive connection between inner conductors 4.1; 4.2 and inner conductor contacts 12,1; 12,2, insulation 6 is partially removed from both of the inner conductors 4.1; 4.2, the exposed inner conductors 4.1; 4.2 being crimped to connecting portions 14.1; 14.2. Inner conductors 4.1; 4.2 are disposed at a conductor spacing c from each other. Conductor spacing c is equal to second contact spacing b. Like connector 2, cable 3 is disposed symmetrically in the region of the end portion. Plane of symmetry 17 extends centrally between inner conductors 4.1; 4.2 and inner conductor contacts 12.1, 12.2, parallel to mating direction x and perpendicular to the main plane.

Connector 2 is connected to cable 3 by means of a compression sleeve 24. To this end, both connector 2 and cable 3 are disposed partially within compression sleeve 24. A portion of compression sleeve 24 is compressed onto jacket 9 of cable 3 whereas another portion of the compression sleeve is compressed onto outer conductor sleeve 11. In the present exemplary embodiment, shield 7 is expanded and positioned between compression sleeve 24 and a pressing region 25 of outer conductor sleeve 11. In this way, an electrically conductive connection is created between outer conductor sleeve 11 and shield 7. In addition to pressing region 25, outer conductor sleeve 11 has an intermediate region 26 adjoining pressing region 25 in mating direction x. Inner conductors 4.1; 4.2 extend through pressing region 25 and intermediate region 26 parallel to mating direction x and in spaced-apart relation to outer conductor sleeve 11 up to the connecting portion 14.1; 14.2 of the respective inner conductor contact 12.1; 12.2. However, in pressing region 25, inner conductors 4.1; 4.2 are spaced from outer conductor sleeve 11 by a greater distance than in intermediate region 26. This is achieved by outer conductor sleeve 11 having a larger inner diameter in the pressing region than in intermediate region 26.

Figure 2:
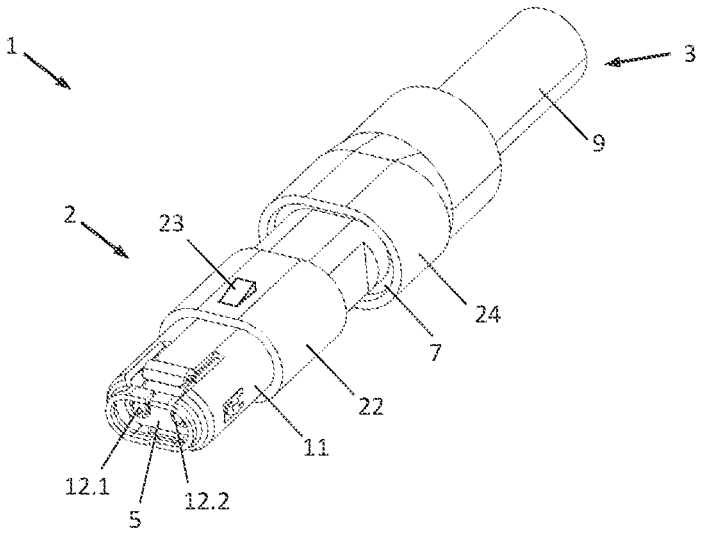
FIG. 2 is a three-dimensional view of an embodiment of the connector assembly according to the invention.

FIG. 2 shows, in three-dimensional view, an embodiment of the inventive connector assembly 1. Connector 2 is connected to cable 3 via a compression sleeve 24. Outer conductor sleeve 11 is surrounded by a collar member 22. Collar member 22 is made of plastic and has a fastening element 23. Connector 2 can be connected to a connector housing via fastening element 23.

Figure 3A:
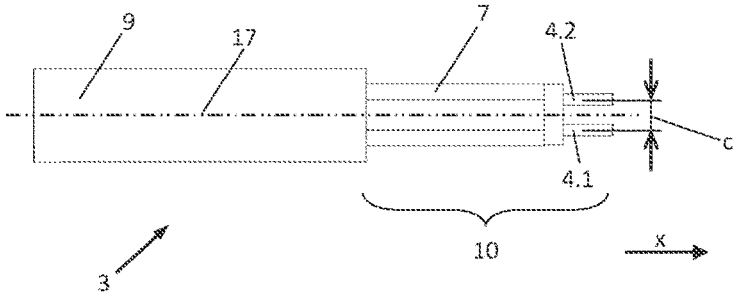
FIGS. 3*a*, 3*b* and 3*c* are each different views of an embodiment of a cable for a connector assembly according to the invention.
Figure 3B:
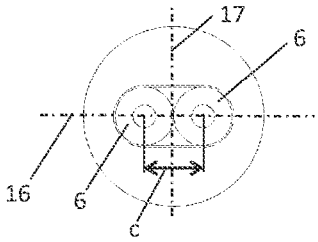
Figure 3C:
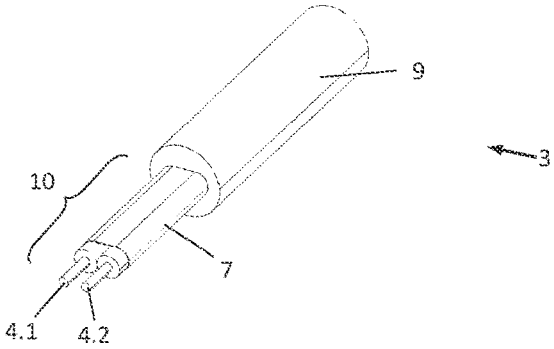

FIGS. 3*a* through 3*c* show, in different views, an embodiment of a cable 3 for a connector assembly according to the invention. In end portion 10 of cable 3, inner conductors 4.1; 4.2 are stripped of jacket 9, shield 7 surrounding the two inner conductors 4.1; 4.2. In a later process step, shield 7 is shortened and expanded so that inner conductors 4.1; 4.2 are also freed from shield 7 in end portion 10. In end portion 10, inner conductors 4.1; 4.2 are disposed parallel to each other and parallel to mating direction x. Outside the end portion 10, inner conductors 4.1; 4.2 are twisted together. Furthermore, inner conductors 4.1; 4.2 are disposed with their central axes in main plane 16. Moreover, in end portion 10, inner conductors 4.1; 4.2 are disposed at a conductor spacing c from each other and symmetrically with respect to the plane of symmetry 17.

Figure 4A:
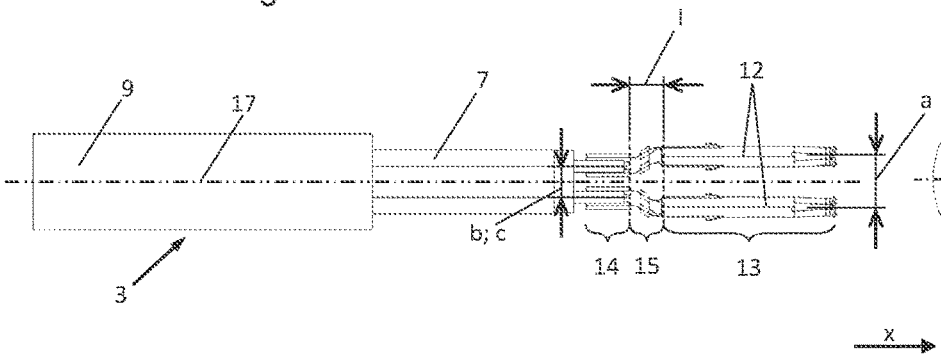
FIGS. 4*a* and 4*b* are different views of an embodiment of a partially terminated cable for a connector assembly according to the invention.
Figure 4B:
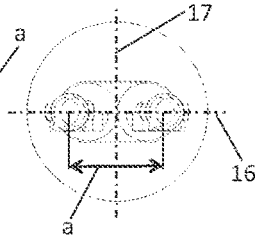

FIGS. 4*a* through 4*b* show, in different views, an embodiment of a partially terminated cable 3 for a connector assembly according to the invention. Cable 3 is electrically conductively connected via its inner conductors 4 to inner conductor contacts 12. Inner conductor contacts 12 are each divided into a mating portion 13, a connecting portion 14, and a transition portion 15. Mating portions 13 of inner conductor contacts 12 are disposed with their central axes in main plane 16. Transition portions 15 each form an angle with the plane of symmetry 17, the tangent function of which angle is equal to the result of a quotient whose dividend is given by the difference between the first contact spacing (a) and the second contact spacing (b) and whose divisor is given by twice the length (l) of transition portion (15). The length (l) of transition portion (15) is determined parallel to mating direction (x).

The explanations provided with regard to the figures are merely for the sake of illustration and are not to be construed as limiting.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE CHARACTERS

1 connector assembly
2 connector
3 cable
4 inner conductor
5 insulator
6 insulation
7 shield
8 shielding film
9 jacket
10 end portion
11 outer conductor sleeve
12 inner conductor contact
13 mating portion
14 connecting portion
15 transition portion
16 main plane
17 plane of symmetry
18 latching nose
19 socket chamber
20 first socket chamber portion
21 second socket chamber portion
22 collar member
23 fastening element
24 compression sleeve
25 pressing region
26 intermediate region
27 recess
a first contact spacing
b second contact spacing
c conductor spacing
L length of the transition portion
x mating direction

What is claimed is:

1. A connector assembly, comprising:

a connector having an outer conductor sleeve, a first and a second inner conductor contact being disposed within the outer conductor sleeve; and a cable connected to the connector, the cable having a first and a second insulated inner conductor, a shield surrounding the first and second inner conductors, and a jacket surrounding the shield, the first and second inner conductors being stripped of the shield and the jacket in an end portion of the cable, wherein the first and second inner conductor contacts each have a mating portion by which the first and the second inner conductor contacts are connectable to complementary inner conductor contacts of a mating connector, a connecting portion in which the first inner conductor contact is electrically conductively connected to the first inner conductor and the second inner conductor contact is electrically conductively connected to the second inner conductor, and a transition portion that connects the mating portion to the connecting portion, wherein the first and second inner conductor contacts are disposed parallel to each other in the mating portion and in the connecting portion, wherein the first and second inner conductor contacts have a first contact spacing in the mating portion and a second contact spacing in the connecting portion, the first contact spacing being greater than the second contact spacing, wherein, in the transition portion, a transition from the first contact spacing to the second contact spacing occurs continuously over a length of the transition portion, and wherein, in the end portion, the first and second inner conductors are disposed parallel to each other within the outer conductor sleeve and in spaced-apart relation to the outer conductor sleeve, and are spaced apart by a conductor spacing equal to the second contact spacing and to a distance, which is in a direction perpendicular to a longitudinal extent of the cable, between centers of cross-sections of the first and second inner conductors in a region of the cable adjacent to the end portion at which the first and second inner conductors are disposed within the jacket and/or the shield.

2. The connector assembly as recited in claim 1, wherein the mating portions of the first and second inner conductor contacts are disposed in a main plane.

3. The connector assembly as recited in claim 2, wherein the first and second inner conductor contacts are disposed symmetrically with respect to each other, a plane of symmetry being perpendicular to the main plane and parallel to the mating direction.

4. The connector assembly as recited in claim 3, wherein, in the transition portion, the first and/or the second inner conductor contact(s) form(s) an angle with the plane of symmetry, a tangent function of the angle being equal to the result of a quotient whose dividend is given by the difference between the first contact spacing and the second contact spacing and whose divisor is given by twice the length of the transition portion.

5. The connector assembly as recited in claim 1, wherein the first and second inner conductors are disposed within a shielding film, at least in the end portion.

6. The connector assembly as recited in claim 1, wherein the connector has an insulator which has a first and a second socket chamber and is disposed within the outer conductor sleeve, the first inner conductor contact being disposed in the first socket chamber, and the second inner conductor contact being disposed in the second socket chamber.

7. The connector assembly as recited in claim 6, wherein the first and second socket chambers each have a first and a second socket chamber portion, each first socket chamber portion accommodating therein the respective mating portion, and each second socket chamber portion accommodating therein the respective connecting portion and the respective transition portion of the respective inner conductor contact, the first socket chamber portions having a smaller diameter than the second socket chamber portions.

8. The connector assembly as recited in claim 6, wherein, in a region of the insulator, the outer conductor sleeve has a collar member disposed on a side facing away from the insulator, the collar member having at least one fastening element.

9. The connector assembly as recited in claim 1, wherein the connector is connected to the cable via a compression sleeve.

10. The connector assembly as recited in claim 9, wherein the shield is disposed between the compression sleeve and the outer conductor sleeve.

11. The connector assembly as recited in claim 10, wherein the outer conductor sleeve is connected to the compression sleeve and the shield in a pressing region, the outer conductor sleeve having an intermediate region adjoining the pressing region, and the first and second inner conductors being spaced from the outer conductor sleeve by a greater radial distance in the pressing region than in the intermediate region.

12. The connector assembly as recited in claim 11, wherein, in the connecting portions, the inner conductor contacts are spaced from the outer conductor sleeve by a radial distance greater than a distance between the inner conductors and the outer conductor sleeve in the intermediate region.

13. The connector assembly as recited in claim 11, wherein, in the connecting portions, the inner conductor contacts are spaced from the outer conductor sleeve by a radial distance equal to a distance between the inner conductors and the outer conductor sleeve in the pressing region.

14. The connector assembly as recited in claim 1, wherein the conductor spacing in the end portion is a shortest distance between the conductors in the direction perpendicular to a longitudinal extent of the cable, and is equal to a sum of radii of the first and second inner conductors.

15. The connector assembly according to claim 1, wherein the conductor spacing in the end portion is the same as a distance, which is in the direction perpendicular to a longitudinal extent of the cable, between the first and second inner conductors within the cable along the longitudinal extent of the cable.

* * * * *